US010012457B2

(12) United States Patent
Jones

(10) Patent No.: US 10,012,457 B2
(45) Date of Patent: Jul. 3, 2018

(54) TAKE-DOWN COMPACT PRECISION RIFLE

(71) Applicant: The United States of America as Represented by the Secretary of the Navy, Washington, DC (US)

(72) Inventor: Michael H Jones, Bedford, IN (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/358,343

(22) Filed: Nov. 22, 2016

(65) Prior Publication Data

US 2018/0017346 A1 Jan. 18, 2018

Related U.S. Application Data

(60) Provisional application No. 62/362,258, filed on Jul. 14, 2016.

(51) Int. Cl.

| | |
|---|---|
| ***F41A 3/66*** | (2006.01) |
| ***F41A 3/30*** | (2006.01) |
| ***F41A 21/48*** | (2006.01) |
| ***F41C 23/00*** | (2006.01) |

(52) U.S. Cl.

CPC *F41A 3/66* (2013.01); *F41A 3/30* (2013.01); *F41A 21/484* (2013.01); *F41C 23/00* (2013.01)

(58) Field of Classification Search

CPC ..... F41A 3/14; F41A 3/16; F41A 3/30; F41A 3/66; F41A 21/48; F41A 21/484; F41A 23/00; F41A 23/20

USPC ..... 42/16, 16.1

See application file for complete search history.

(56) References Cited

U.S. PATENT DOCUMENTS

| | | | | | |
|---|---|---|---|---|---|
| 3,003,400 | A * | 10/1961 | Johnson | F41A 5/18 | 42/75.02 |
| 4,473,964 | A * | 10/1984 | Straub | F41A 25/22 | 124/68 |
| 5,020,260 | A * | 6/1991 | Houghton | F41A 21/481 | 42/75.01 |
| 5,351,428 | A * | 10/1994 | Graham | F41A 11/04 | 42/106 |
| 7,905,041 | B1 * | 3/2011 | Davies | F41A 3/66 | 42/75.02 |
| 8,959,821 | B1 * | 2/2015 | Calvert | F41A 21/484 | 42/76.01 |
| 2002/0162266 | A1 * | 11/2002 | Clay | F41A 11/00 | 42/75.02 |
| 2005/0188584 | A1 * | 9/2005 | Orth | F41A 11/04 | 42/71.01 |
| 2005/0215092 | A1 * | 9/2005 | Schoppman | F41A 11/04 | 439/101 |
| 2006/0026883 | A1 * | 2/2006 | Hochstrate | F41C 23/16 | 42/75.01 |
| 2010/0229445 | A1 * | 9/2010 | Patel | F41A 3/66 | 42/6 |

(Continued)

*Primary Examiner* — Bret Hayes

(74) *Attorney, Agent, or Firm* — Christopher A. Monsey

(57) ABSTRACT

A take-down rifle including modular components. A first and a second rifle section comprising first and second receiver portions, respectively, allow the rifle to be quickly assembled and disassembled. The first rifle section also includes a rifle barrel. Mounting points on the first rifle section allow a coupled optical sight to remain fixed in relation to the barrel after assembly or disassembly so that the optical sight remains zeroed.

9 Claims, 4 Drawing Sheets

(56) References Cited

U.S. PATENT DOCUMENTS

| | | | | |
|---|---|---|---|---|
| 2012/0137563 | A1* | 6/2012 | Ubl | F41C 23/16<br>42/75.03 |
| 2017/0227309 | A1* | 8/2017 | Faxon | F41A 3/66 |

* cited by examiner

TAKE-DOWN COMPACT PRECISION RIFLE

CROSS-REFERENCE TO RELATED APPLICATIONS

The present application claims priority to U.S. Provisional Patent Application Ser. No. 62/362,258, filed Jul. 14, 2016, entitled "TAKE-DOWN COMPACT PRECISION RIFLE," the disclosure of which is expressly incorporated by reference herein.

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon. This invention (Navy Case 200,367) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to compact precision rifle which may be broken down for transport, reassembled, and employed to engage a target up to 500 meters away without the need to re-zero rifle before engagement.

A rifle is a collection of components designed to enable an operator to place a round as close as possible to a chosen target located some distance from the operator. Generally, traditional components may be grouped into four categories based on function. In one example, a first group, which will be referred to as the "trajectory group", comprises those components which are in direct contact with the round from the moment of ignition until the bullet leaves the firearm, and establish the bullet's trajectory. Exemplary primary components of a trajectory group are a barrel and a chamber. The exemplary barrel can be a metal tube with a uniform interior diameter through which the bullet travels after ignition. Affixed to an end of the barrel is the chamber. The exemplary chamber is a metal tube with a larger interior diameter than the barrel, which holds the cartridge ready for firing. The exemplary cartridge, also known as a "round" or "load", consists of a cartridge case, primer, powder and bullet.

An exemplary second generalized group comprises those components involved in handling live cartridges and empty cartridge cases, and triggering activation of the primer. Some exemplary primary components of the second group include the action, receiver, bolt, firing mechanism, trigger, and magazine. In this example, the term "action" refers to a mechanism which inserts the live cartridge into the chamber and removes the cartridge case after firing. In some examples, action can also refer to a mechanism which positions a firing mechanism to contact the primer. The exemplary bolt can be a component of the exemplary action and can include a firing pin which will strike the primer when triggered, resulting in ignition of powder. The exemplary receiver can be a component of the action which guides the bolt and secures the bolt at the base of the cartridge. In at least some examples, the term "trigger" can refer to a mechanism which releases the firing pin to contact the primer.

An exemplary third group can comprise those components which hold the first and second groups and fit the firearm to the operator. Exemplary primary components of this third group, which will be referred to as the "stock", can include a buttstock, forend and grip. The exemplary buttstock can be a portion of the firearm shouldered by the operator. The exemplary grip can be a portion held by an operator's hand which will activate the trigger. The exemplary forend can be a portion of the stock closest to the barrel which may be held by the operator's other hand. The exemplary forend can also form a portion of the stock which is stabilized on a fixed object or bipod during employment.

An exemplary fourth group can comprise a sighting system. This group can include any modality utilized by the operator to aim the firearm. In the case of exemplary embodiments of the present invention, the sighting system can include a scope mounted to the outer surface of the chamber.

When it comes to effectively engaging targets at the ranges contemplated in at least some embodiments of this invention, two parameters or designs that influence desired results can include weapons accuracy and precision with which it may be employed. Though "accuracy" and "precision" are often considered synonyms, they are in fact distinct characteristics affecting whether target will be effectively engaged with each functioning of the rifle. In this context, "accuracy" refers to how closely grouped a series of shots will be, while "precision" refers to the ability to repeatedly bring the accuracy to bear on a particular aimpoint. An exemplary embodiment rifle's inherent accuracy may be measured by operating the firearm from a mechanical support structure which removes the influences of the operator on the trajectory of the bullet.

A rifle's inherent accuracy is affected by even very minor deviations in manufacturing, assembly and functioning of the firearm. Deviations of a rifle barrel can be measured, for example, to the ten-thousandth of an inch. Individual component and interface deviations from an exemplary normative perfect can be combined into a "tolerance-stack" model. The tolerance-stack affects trajectory of the bullet and these effects are magnified by the range to a target. In other words, if a distance between any two rounds of a three round group was one inch or less when a target was 100 meters from an operator, then the distance would expand or increase five inches if the target were 500 meters away. Thus, an accurate rifle is one with a smallest desired tolerance-stack. Effects of atmospheric conditions and differences in ammunition are ignored for purposes of at least some embodiments of this invention.

An exemplary rifle's inherent accuracy, as opposed to the precision with which it may be employed, is most affected by deviations within a trajectory group. A trajectory group can be defined as a group with a direct impact on a trajectory of a fired bullet. In an instant following release of a firing pin, all mechanical actions have completed and errors affecting a trajectory of a fired bullet are those originating in a chamber and barrel. In this context, a critical interface impacting accuracy is one between the chamber and the barrel.

The deviations from the normative perfect found within the barrel and the chamber are the result of the manufacturing process. The deviation resulting from the mating of the chamber to the barrel at the critical chamber/barrel interface is created during the rifle's assembly. In order to employ a weapon with precision, an operator will "zero" a rifle. Zeroing a rifle is the process whereby adjustments are made to the sighting system to bring the operator's view of the aimpoint into alignment with an impact point of a three-round group. Generally, an operator can fire three rounds at a desired aimpoint and observe projectile or bullet impacts. The operator then measures a distance of the impacts from the aimpoint and makes adjustments to the sighting system to correct for deviation. These adjustments compensate for a trajectory group's tolerance stack and allow the weapon to be used with increased precision. So long as new errors are not introduced into the tolerance stack, this alignment of the sighting system to the rifle's inherent accuracy will not need to be re-accomplished. However, if errors are introduced, such as by optics being removed or a barrel being separated from a chamber, then the operator will be unable to engage a target with any confidence that a bullet will hit its mark until the weapon is re-zeroed.

A take-down rifle can be defined as a rifle which is designed to be transported in two or more pieces which are each shorter than a fully assembled rifle. Creation of a take-down rifle was most commonly achieved in existing designs by an inclusion of a mechanism whereby a barrel was easily separated at a barrel/chamber interface while a chamber remained affixed to the rest of the firearm. While a barrel/chamber interface and affixed chamber approach does result in a compact weapon, it also disturbs critical barrel/chamber interface, thus ruining the weapon's zero. Alternatively, other approaches merely removed the stock from the rifle while the trajectory group remained intact. This approach preserves the rifle's zero but does not create a truly compact package for transportation. Neither of these approaches are adequate for scenarios calling for transporting the rifle in a disguised manner, assembling the rifle, and engaging a target at 500 meters without the opportunity to reestablish zero.

Various embodiments of this disclosure move the take-down point from within the critical trajectory group and into the second generalized group to a point which will not affect either the rifle's zero or its inherent accuracy. The critical barrel chamber interface remains undisturbed and the sighting system, being mounted to the outer surface of the chamber, will retain its corrections for the error stack. The exemplary primary take-down point is established by dividing the receiver into two pieces at a selected distance from a rear of a chamber. At a point where such a division is created, the receiver is serving only as a guide for travel of a bolt as it locks a live round into the chamber and extracts the spent cartridge case. Thus, creating an interface between a forward portion of the receiver and a rearward portion of the receiver will have no impact on the rifle's inherent accuracy. An exemplary rifle may be even further broken down by creating a second take-down point within its stock wherein a buttstock is separated from a grip. By utilizing this exemplary approach, it will be possible to break down a rifle so that it may be carried within a brief case or other similarly sized container, assembled, and used to engage a target at 500M without a need to reestablish zero.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Embodiments of the invention described herein are not intended to be exhaustive or to limit the invention to precise forms disclosed. Rather, the embodiments selected for description have been chosen to enable one skilled in the art to practice the invention.

Figure 1:
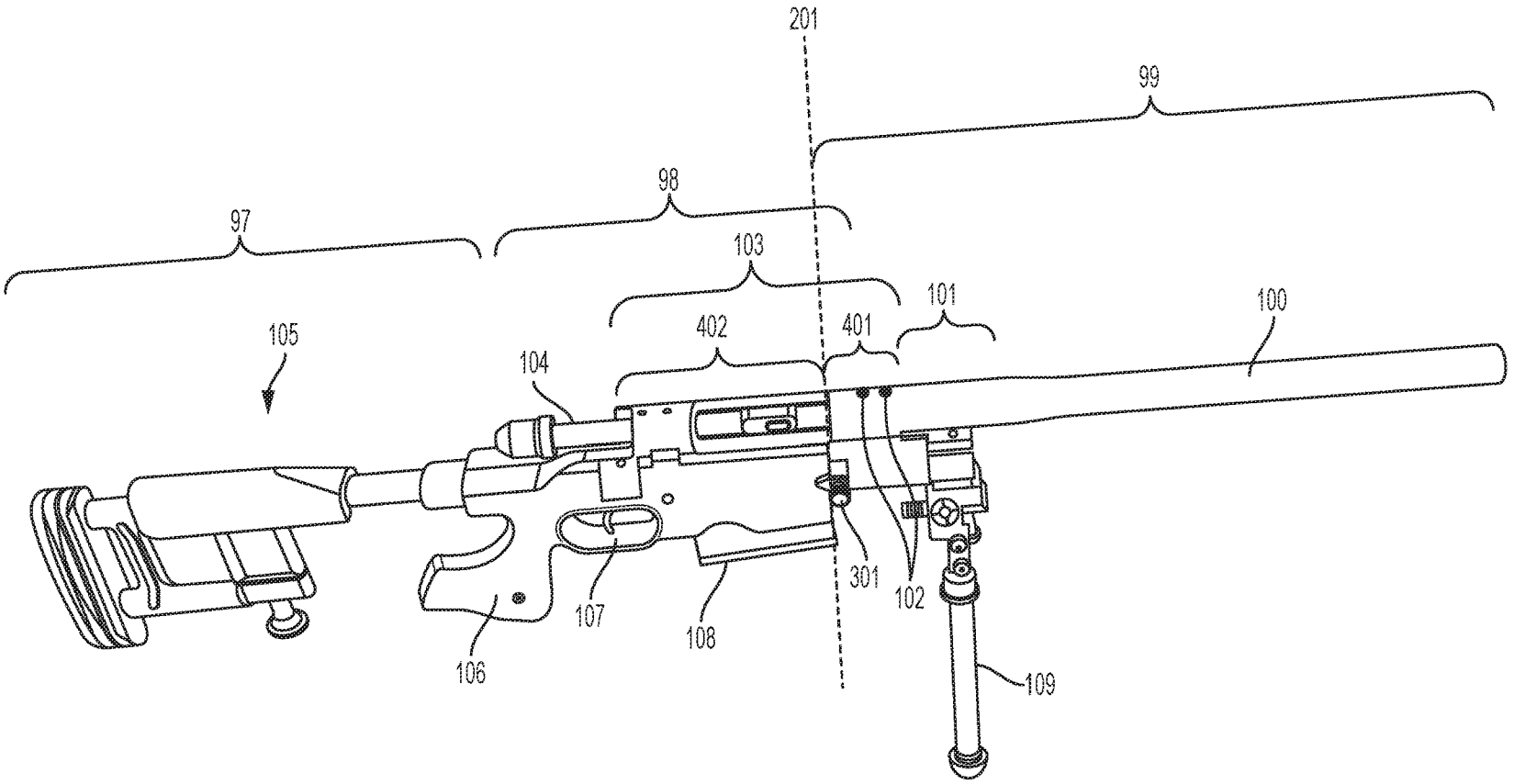
FIG. 1 shows an exemplary take-down compact precision rifle in its assembled configuration.

Referring initially to FIG. 1, an embodiment of the invention comprises components of the U.S. Military's proven MK 13 precision rifle platform. An exemplary primary take-down point 201 can be manufactured to divide rifle into a first rifle portion 99 and a second rifle portion 98. A receiver 103 is divided at the primary take-down point 201 into a first receiver section 401 and a second receiver section 402. The first receiver section 401 is coupled to a barrel 100 that is included in the first rifle portion 99. The second receiver section 402 is part of the second rifle portion 98. A chamber 101 is either coupled with or formed into the rifled barrel 100. In other words, in at least one possible embodiment, the exemplary chamber 101 is milled or forged inside the barrel 100. The end of the barrel 100 that is formed with the chamber 101 is coupled with (e.g., screwed into) the first receiver section 401. The receiver 103 receives and guides a bolt 104 as the bolt 104 removes a live round (not shown) from a magazine 108 and locks the live round into the chamber 101. The bolt 104 includes a firing pin (not shown) and positions the firing pin so that an activation of a trigger 107 will release the pin causing it to contact with the round's primer. A sighting or optics system (not shown) is mounted to an exterior surface of a section of the rifle that houses or encloses the chamber 101 at mounting points 102. A buttstock 105 may be used to brace the rifle platform against an operator's shoulder. A grip 106 provides support for the operator's trigger hand. A bi-pod 109 can be coupled on one end to a forward portion of the platform.

Figure 2:
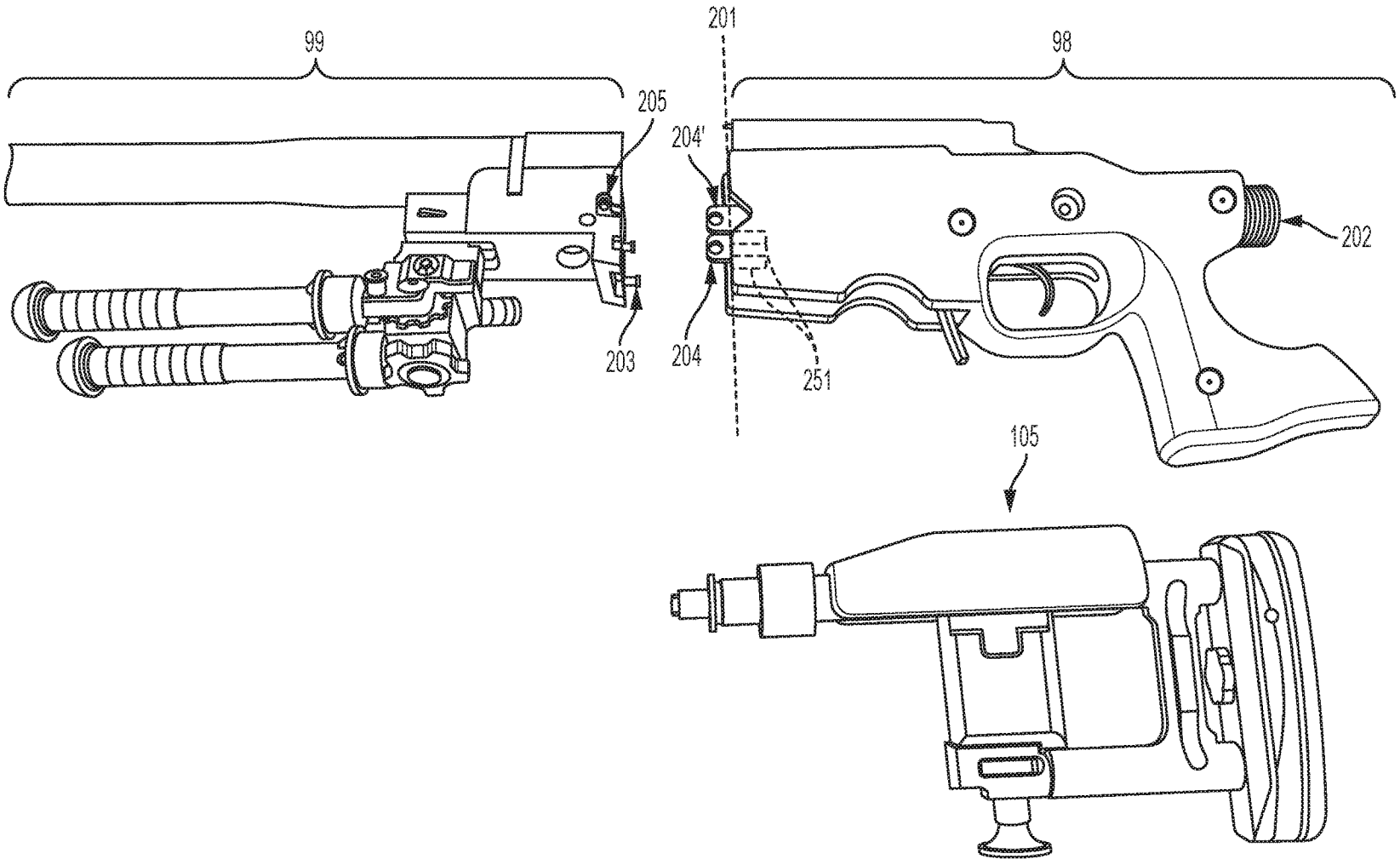
FIG. 2 shows an exemplary take-down compact precision rifle disassembled for transportation.

FIG. 2 shows the platform of FIG. 1 disassembled for transportation. The exemplary primary take-down point 201 is shown dividing the receiver 103 see FIG. 1) into the first receiver section 401 and the second receiver section 402 see FIG. 1). The barrel 100 couples (e.g., screws into) with the first receiver section 401 see FIG. 1). Alignment pins 203 can be embedded within the first rifle portion 99 such that alignment pins 203 can enter recesses 251 to ensure proper alignment of the first rifle portion 99 with the second rifle portion 98 during reassembly. The first and second rifle portions 99, 98 may be reassembled by inserting a locking pin 301 (see FIG. 1) through a pair of locking tabs 204, 204' formed on the second rifle portion 98 and through a corresponding hole 205 formed in the first rifle portion 99 that is perpendicular to an axis passing through a center of the barrel 100 (see FIG. 1). The sighting or optics system (not shown) is fixed with respect to the first rifle portion of the takedown rifle in order avoid a need to readjust the sighting alignment based on disassembly of the rifle. A second take-down section 202 can be manufactured on an end of the second rifle portion 98 opposing the first rifle portion 99 to allow a third rifle portion 97 (including, e.g., the buttstock 105 see FIG. 1)) to be detached from the second rifle portion 98 which includes grip 106 see FIG. 1).

Figure 3:
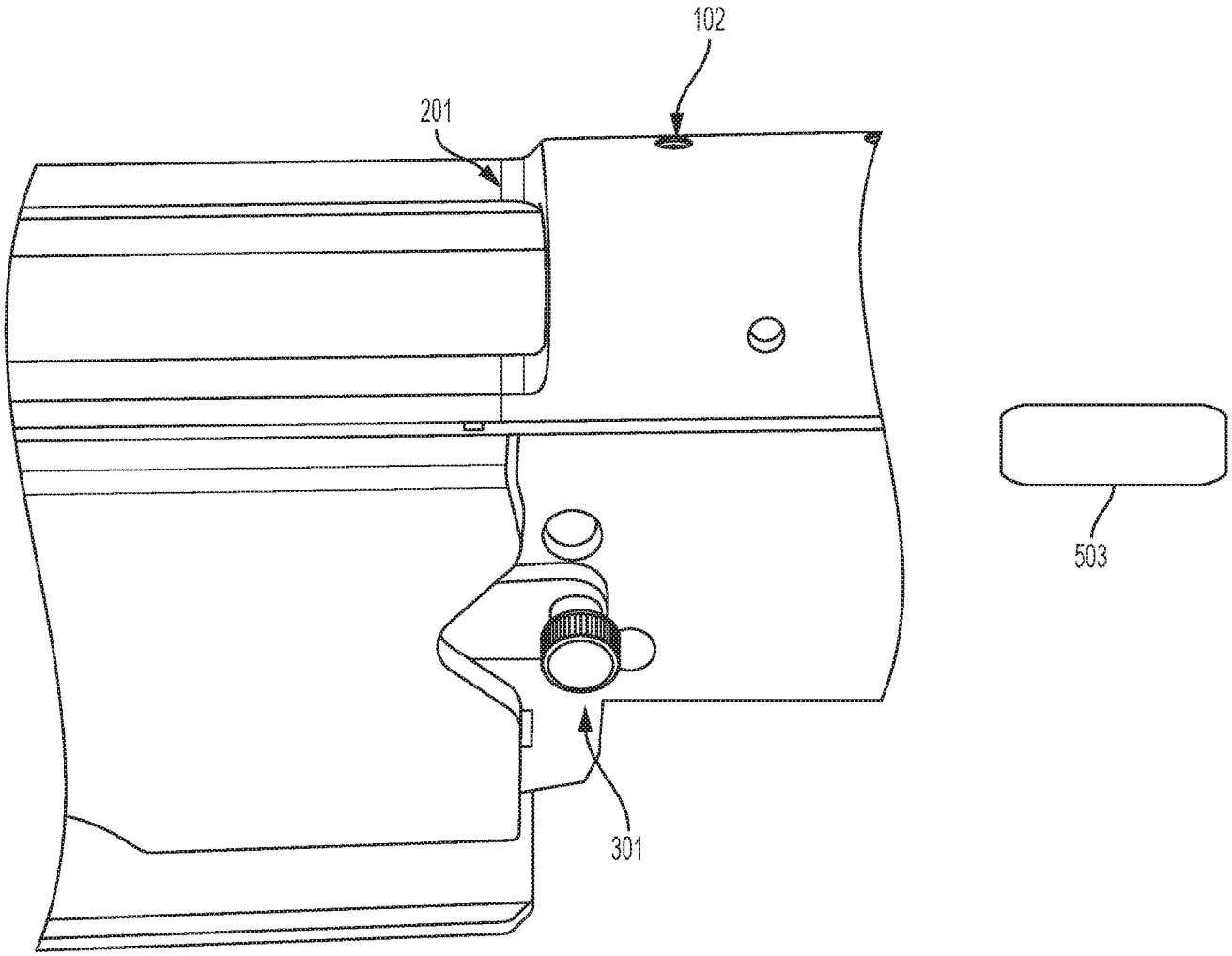
FIG. 3 shows a close-up view of an exemplary primary take-down point.

FIG. 3 shows a close-up view of exemplary primary take-down point 201 in its assembled configuration. The first rifle portion 99 (see FIG. 2) and the second rifle portion 98 (see FIG. 2) of the platform are locked into an exemplary assembled configuration through the use of locking pin 301. Other design approaches can be used to couple or lock the first and second rifle portions 99, 98 (see FIG. 2). A sighting or optics system 503 can be coupled to mounting points 102.

Figure 4:
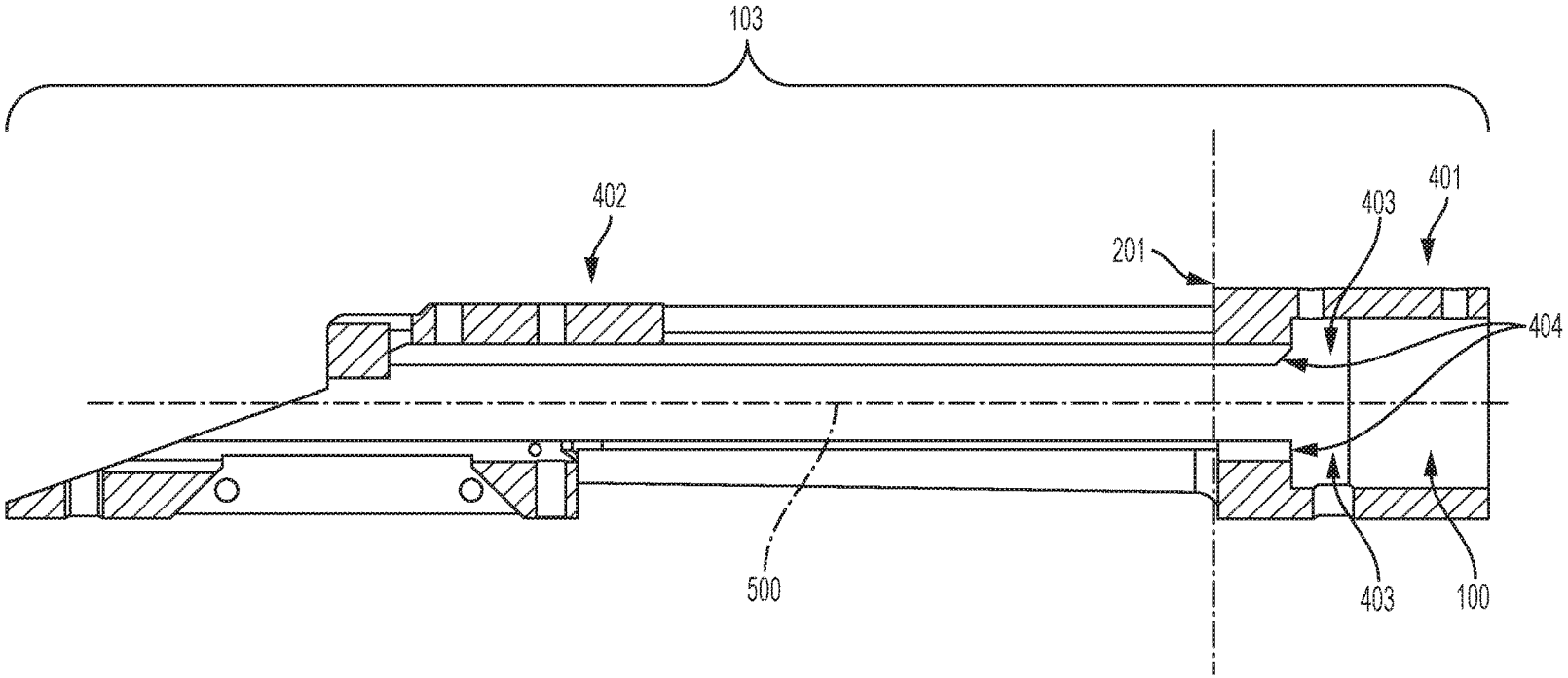
FIG. 4 shows a cross-section view of an exemplary bolt-action receiver.

FIG. 4 shows a cross-section view of an exemplary bolt-action receiver 103. In this exemplary disclosure, as discussed above, the receiver 103 is divided at primary take-down point 201 into the second receiver section 402 and the first receiver section 401. The first receiver section 401 is formed to accept a forward end of the bolt 104 (See FIG. 1) and capture locking lugs into locking lug cavities 403 formed thereon with corresponding locking surfaces 404. Axis 501 extends through the center of barrel 100.

The invention claimed is:

1. A take-down compact precision rifle comprising:

a first section comprising a rifled barrel having a first axis passing through a center of the rifled barrel, the rifled barrel having an open first end and an open second end, a chamber section formed into said rifled barrel's first end configured to accept a selected caliber of cartridge, and a first receiver portion that insertably or threadably receives the rifled barrel's first end, the first receiver portion having a plurality of locking surfaces configured to capture a corresponding plurality of locking lugs formed on a leading edge of a rifle bolt, wherein said first section is further formed with a plurality of mounting points for a sighting system, wherein said mounting points are on an outer surface of said first section that surrounds the chamber section; and a second section comprising a second receiver portion, said second section further comprising a plurality of locking tabs extending away from the second section parallel to the first axis configured to align with corresponding locking holes in said first section and further configured to accept a locking pin which releasably passes into the tabs and locking holes to secure the first and second sections together in a fixed assembly;

wherein said first section further comprises a plurality of guide pins extending away from a mating section formed on one end of the first section that are configured to align with corresponding recesses in said second section when the first section is coupled with the second section so as to align the first and second receiver portions along the first axis to permit the bolt to pass freely between the first and second receiver portions.

2. The apparatus of claim 1, further comprising a second takedown coupling section between a buttstock and the second section, wherein the second takedown coupling section couples with the second section on an end of the second section which opposes the first section and the buttstock, wherein the second section further comprises a grip section.

3. The apparatus of claim 1, further comprising a sighting system, wherein said sighting system is coupled with said plurality of mounting points.

4. The apparatus of claim 1, further comprising a bolt that is slideably inserted into the first and second receiver portions.

5. The apparatus of claim 4, wherein the bolt is coupled to the second receiver portion.

6. A method of assembling a rifle, comprising:

providing a take-down compact precision rifle comprising:

a first section comprising a rifled barrel having a first axis passing through a center of the rifled barrel, the rifled barrel having an open first end and an open second end, a chamber section formed into said rifled barrel's first end configured to accept a selected caliber of cartridge, and a first receiver portion that insertably or threadably receives the rifled barrel's first end, the first receiver portion having a plurality of locking surfaces configured to capture a corresponding plurality of locking lugs formed on a leading edge of a rifle bolt, wherein said first section is further formed with a plurality of mounting points for a sighting system, wherein said mounting points are on an outer surface of said first section that surrounds the chamber section; and a second section comprising a second receiver portion, said second section further comprising a plurality of locking tabs extending away from the second section parallel to the first axis configured to align with corresponding locking holes in said first section and further configured to accept a locking pin which releasably passes into the tabs and locking holes to secure the first and second sections together in a fixed assembly;

wherein said first section further comprises a plurality of guide pins extending away from a mating section formed on one end of the first section that are configured to align with corresponding recesses in said second section when the first section is coupled with the second section so as to align the first and second receiver portions along the first axis to permit the bolt to pass freely between the first and second receiver sections; and assembling the first and second portions by mating the first section with the second section using the guide pins so the first and second receiver portions align with each other and with the first axis passing through the first and second receiver portions and further inserting the locking pin into the tabs and locking holes.

7. The method of claim 6, further comprising:

providing a second takedown coupling section between a buttstock and the second section, wherein the second takedown coupling section couples with the second section on an end of the second section which opposes the first section and the buttstock, wherein the second section further comprises a grip section; and coupling the buttstock with the second section at the second takedown section coupling section.

8. The method of claim 6, further comprising:

providing a sighting system and coupling the sighting system with said plurality of mounting points.

9. The method of claim 6, further comprising providing:

a bolt that is slideably inserted into the first and second receiver portions; and coupling the bolt into the second receiver portion.

* * * * *